US007287949B2

(12) United States Patent
Huissoon

(10) Patent No.: US 7,287,949 B2
(45) Date of Patent: Oct. 30, 2007

(54) MOBILE APPARATUS FOR EARTH MOVING AND OTHER OPERATIONS SUCH AS LIFTING AND DISPLACING OF LOADS

(76) Inventor: Dingenis Laurens Huissoon, Eindje de Rondte 4, 4416 CS Kruiningen (NL)

( * ) Notice: Subject to any disclaimer, the term of this patent is extended or adjusted under 35 U.S.C. 154(b) by 0 days.

(21) Appl. No.: 10/503,851

(22) PCT Filed: Feb. 3, 2003

(86) PCT No.: PCT/NL03/00075

§ 371 (c)(1),
(2), (4) Date: Aug. 5, 2004

(87) PCT Pub. No.: WO03/066981

PCT Pub. Date: Aug. 14, 2003

(65) Prior Publication Data

US 2005/0076546 A1 Apr. 14, 2005

(30) Foreign Application Priority Data

Feb. 7, 2002 (NL) ..... 1019918

(51) Int. Cl.
*E02F 3/28* (2006.01)

(52) U.S. Cl. ..... 414/685; 414/694; 414/722

(58) Field of Classification Search ..... 414/685, 414/694, 722, 917; 212/300
See application file for complete search history.

(56) References Cited

U.S. PATENT DOCUMENTS 5,054,990 A 10/1991 Schaeff
5,625,967 A 5/1997 Kulle

FOREIGN PATENT DOCUMENTS

| | | |
|---|---|---|
| DE | 90 14 849 U | 4/1991 |
| DE | 198 53 523 C1 | 3/2000 |
| EP | 0 299 104 A1 | 1/1989 |
| EP | 0 701 027 A1 | 3/1996 |
| EP | 1 031 264 A1 | 8/2000 |
| EP | 1 245 739 A1 | 10/2002 |
| GB | 2 126 982 A | 4/1984 |
| GB | 2 350 830 A | 12/2000 |

*Primary Examiner*—Donald Underwood
(74) *Attorney, Agent, or Firm*—The Webb Law Firm

(57) ABSTRACT

Disclosed is a mobile apparatus for earth moving and other operations, such as lifting and displacing loads. A frame is displaceable on wheels. An articulated operating arm is supported by the frame for carrying an implement, for instance a container, a digger bucket or wrecking hammer. One or more motors drive the wheels and move the operating arm. The operating arm consists of at least three articulations connected to each other for mutual pivoting on a lying axis. A control member such as a hydraulic cylinder is arranged between each pair of articulations. The third articulation has a greater length than the second one, such that when the articulations are folded against each other, the implement can be freely used at the free end of the first articulation. Thus, the last articulation can be transformed from an articulated arm into a single lifting arm.

10 Claims, 8 Drawing Sheets

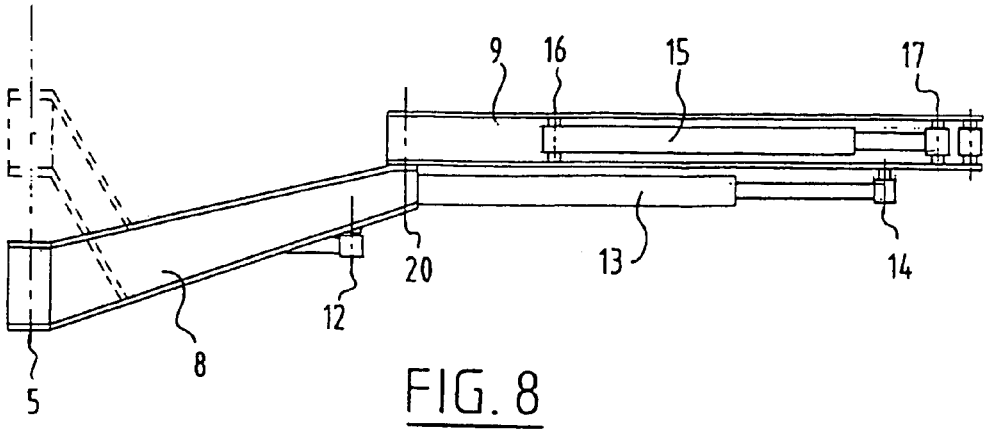
FIG. 8
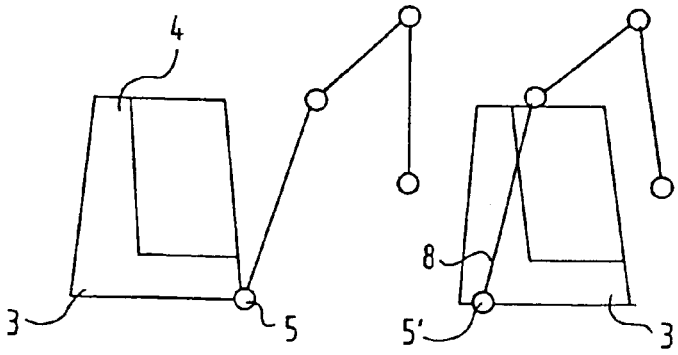
FIG. 9A
FIG. 9B

MOBILE APPARATUS FOR EARTH MOVING AND OTHER OPERATIONS SUCH AS LIFTING AND DISPLACING OF LOADS

BACKGROUND OF THE INVENTION

1. Field of the Invention

The invention relates to a mobile apparatus for earth moving and other operations, such as lifting and displacing loads, which apparatus comprises a frame displaceable on wheels, an articulated operating arm supported by the frame for carrying an implement, for instance a container, a digger bucket or wrecking hammer, one or more motors for driving the wheels and moving the operating arm, which consists of at least three articulations which are connected to each other for mutual pivoting on a lying axis, wherein a control member such as a hydraulic cylinder or a gear rack is arranged between each pair of articulations.

2. Description of the Related Art

Two types of machine are known in practice, one of which is provided with a digging arm which usually consists of a number of articulations and on the outer end of which is arranged a digger bucket. Earth moving can hereby be carried out, wherein the articulations of the digging arm enable the digger bucket to be carried from a digging position into a lifting position respectively an offloading position.

In another embodiment, mobile apparatuses are provided with a single lifting arm, on the outer end of which can for instance be arranged inserting forks for pallets and the like. Loads can hereby be lifted, stacked and transported between a pick-up and set-down location.

The frame is usually embodied for this purpose with four controllable and driven wheels thereby giving the apparatus a great manoeuvrability.

An apparatus is for instance known from EP 0299104.

BRIEF SUMMARY OF THE INVENTION

The invention is directed to an apparatus with a hydraulic loading shovel and crane which can be used for instance as an excavator. The operating arm has five articulations which are actuated by an actuator. The articulations can be folded in accordion-like manner in order to shorten the operating arm, which does not however influence the function of the operating arm, i.e. if the operating arm had a digging function in the articulated position, the operating arm likewise has a digging function in the folded position.

The invention has for its object to provide an apparatus various operations can be carried out without the digging arm having to be replaced by a lifting arm, and vice versa.

The apparatus according to the invention is distinguished in that the last, third articulation of the operating arm has a greater length than the second one, such that when the articulations are folded against each other the attached implement can be freely used at the free end of the first articulation.

Because the last articulation is longer than the immediately preceding articulation, it can be transformed from an articulated arm into a single lifting arm when the arm is folded together. The outer end of the last articulation is herein free to be provided with for instance a digger bucket as well as a lifting device. Another type of implement, such as a wrecking manner, a trench digger, an asphalt cutter and so on, can of course also be provided.

According to a further feature of the invention it is possible to apply in the arm not only pivoting with a horizontal axis but also pivoting with a vertical axis, whereby it becomes possible not only to move the digging arm up and down in the vertical plane, but also to pivot it relative to the frame in the horizontal plane. This can be the whole arm, but also a part thereof, particularly if the first articulation of the arm is embodied as a portal between which the two other articulations are folded.

A portal-like first articulation can be constructed in one part or from different parts and the dimensions must be such that the third articulation can be fed through.

Within the scope of the invention it is possible to arrange the digging arm not in the centre of the frame, but for instance laterally adjacently of the cab if present. In this case the driver has a clear view of the attached implement.

The invention finally proposes in the preferred embodiment to arrange the first articulated part of the arm in offset manner, in top view, relative to the second articulated part, thereby making the folding easier. This folding is further facilitated by arranging the third articulation in offset manner, in top view, relative to the second one. In the preferred embodiment of the invention all of the at least three articulations are arranged in offset manner, in top view, relative to each other.

This offset embodiment moreover provides the possibility of improving the driver's view of the implement.

In another embodiment the articulations could also be arranged such that they fit over and into each other.

According to a further developed embodiment, at least two control members are arranged between one or each pair of articulations for an improved control of the articulations.

The third articulation must be understood to mean the outer end of the operating arm which is generally assembled from a plurality of parts. According to a first option, the third articulation is formed by inter alia a leg having a length which is greater than the length of the second articulation. According to another variant, the third articulation is formed by a leg with a length which is smaller than or equal to the length of the second articulation, on the outer end of which a parallelogram linkage is arranged, which linkage has dimensions such that the total length of the leg plus the parallelogram linkage is certainly greater than the length of the second articulation. In this way an attached implement is freely usable at the free end of the first articulation in the folded position of the articulations.

According to yet another variant, the third articulation is formed by a leg having a length which is smaller than or equal to the length of the second articulation, on the outer end of which an implement is arranged, which implement is constructed such that the total length of the leg plus the implement is greater than the length of the second articulation.

For rapid coupling and uncoupling of an implement on the outer end of the leg of the third articulation, use is preferably made of a rapid-action coupling. In this manner an implement can be coupled and uncoupled very rapidly in manual, hydraulic, mechanical, electro-mechanical or other suitable manner.

According to a still further developed embodiment of the invention, the articulations are provided with connecting means for mutual connection thereof in the folded position, or for connection to the frame. All static and/or dynamic forces in the operating position of the apparatus can in this way be absorbed in efficient manner. These connecting means can be mechanical, hydraulic, electromagnetic or a combination thereof.

According to a further feature of the invention, the articulations are provided with control members for holding the implement at substantially the same angle relative to the frame when one or more articulations are rotated. In this manner the rotation of the articulations does not influence the position of the implement, which may be desirable when the implement is for instance an inserting fork which must be held horizontally. These control members can be hydraulic, mechanical, electromagnetic or a combination thereof.

Means can further be provided for automatically folding the articulations against and away from each other for the transformation from lifting arm to digging arm and vice versa.

The operating arm can finally be provided with one or more damping systems. The transport of for instance loads, implements or materials such as sand and soil can in this way be carried out more rapidly and more easily. These damping systems can act hydraulically, mechanically, electromagnetically, pneumatically, with a special gas, or with a combination thereof.

BRIEF DESCRIPTION OF THE DRAWINGS

The invention is further elucidated in the figure description following hereinbelow of a number of embodiments. In the drawing:

FIG. 8 shows a top view of the operating arm as according to the schematic representation of FIG. 7D;

FIGS. 9A,B show in each case a side view of two embodiments of a schematically shown cab with operating arm placed relative thereto;

DETAILED DESCRIPTION OF THE INVENTION

Figure 1:
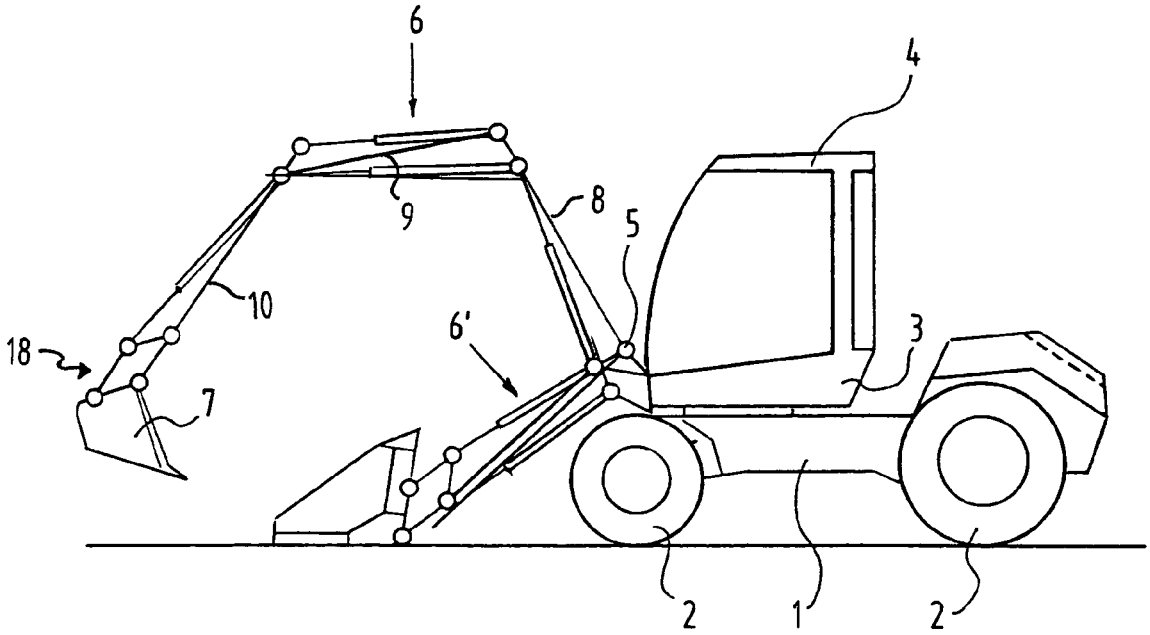
FIG. 1 shows a standing side view of a random frame with an operating arm in the digging position, respectively transporting position.

The same components are designated in the figures with the same reference numerals.

The apparatus shown according to FIG. 1 comprises a displaceable frame 1 supported in the figures by means of steerable wheels 2.

Within the scope of the invention these wheels can also be replaced by caterpillar tracks. A rotatable sub-frame 3 with a cab 4 placed thereon is arranged on the frame.

The first articulation of an operating arm 6 is arranged on the left-hand side of sub-frame 3 at rotation point 5, which operating arm 6 is further elucidated hereinbelow. In FIG. 1 the operating arm 6 is shown in full lines in the digging position and with broken lines in position 6' as load displacing position.

Figure 2:
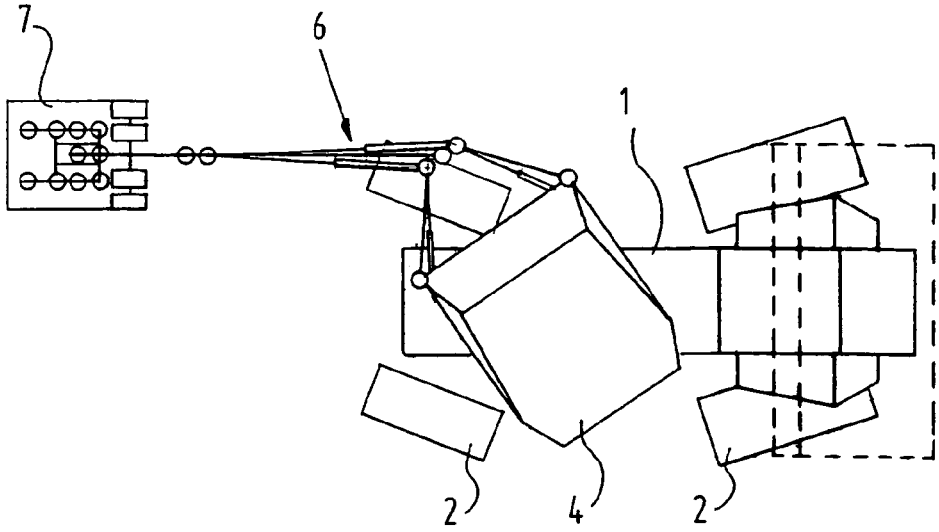
FIG. 2 shows a top view of the apparatus of FIG. 1 in another operating position.

FIG. 2 furthermore shows that a part of operating arm 6 is pivotable in the horizontal plane, so that an optimum freedom of movement of digger bucket 7 on the end of operating arm 6 is possible.

Figure 3:
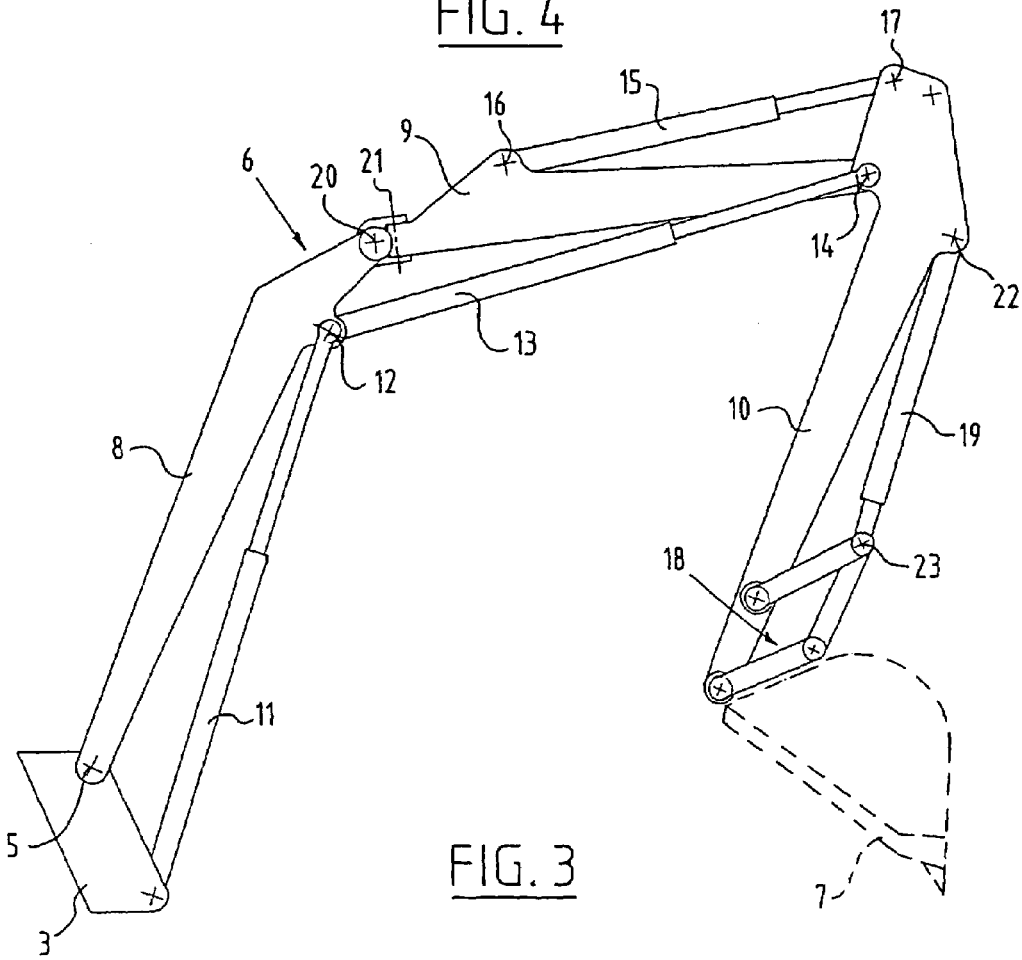
FIG. 3 shows a side view of a first embodiment of the digging arm in the digging position.

FIG. 3 shows in detail the operating arm as it can be used in the apparatus of FIG. 1, 2. Operating arm 6 consists of a first articulation 8, a second articulation 9 and a final articulation 10. The sub-frame is schematically designated with the numeral 3, which sub-frame 3 can have any random adapted form.

The first articulation 8 is supported by a hydraulic cylinder 11 between sub-frame 3 and a pivot point 12 on the upper side of the first articulation 8.

A hydraulic cylinder 13 is arranged between the same axis of hinge 12 at the end of the first articulation 8 and a rotation point 14 at the end of the second articulation. This rotation point 14 also serves for pivotally suspending the third articulation 10 relative to the second articulation 9, wherein a hydraulic cylinder 15 is arranged between pivot point 16 of the second articulation and a pivot point 17 of the third articulation.

On the end of the third articulation is finally mounted a parallelogram linkage 18, to which is fixed a digger bucket or other random implement 7. This can be controlled by a hydraulic cylinder 19 acting between pivot point 22 and pivot point 23 of the telescopic hinge.

Figure 4:
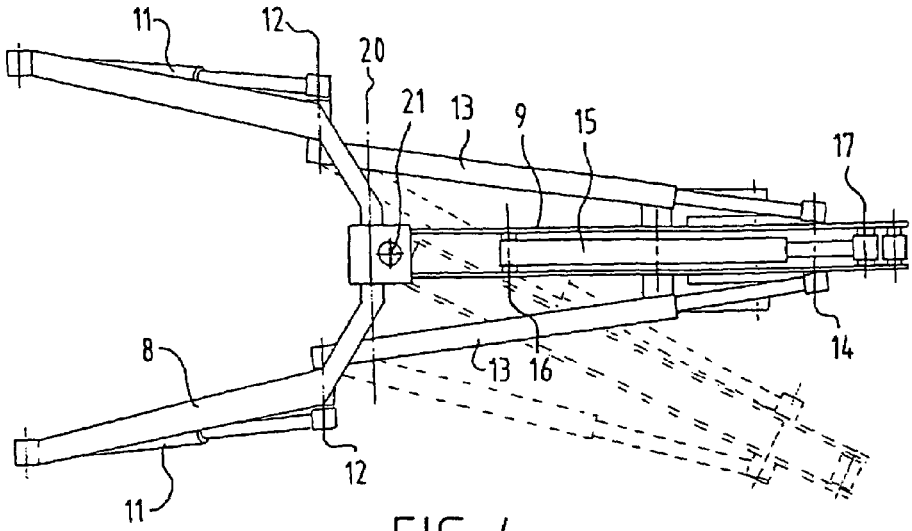
FIG. 4 shows a top view of the arm of FIG. 3.

It is noted that it can be seen in FIG. 4 that the first articulation has a portal-like form, wherein the hinge with horizontal axis 20 between the first articulation 8 and the second articulation 9 is placed roughly in the centre of the portal.

A second hinge with vertical axis 21 is also placed in this centre in order to move the two articulations 9, 10 in lateral direction relative to portal 8. This lateral movement is brought about by asymmetrical driving of the hydraulic cylinder 13 situated on either side of the second articulation 9, so that a lateral pivoting stroke becomes possible.

Figure 5:
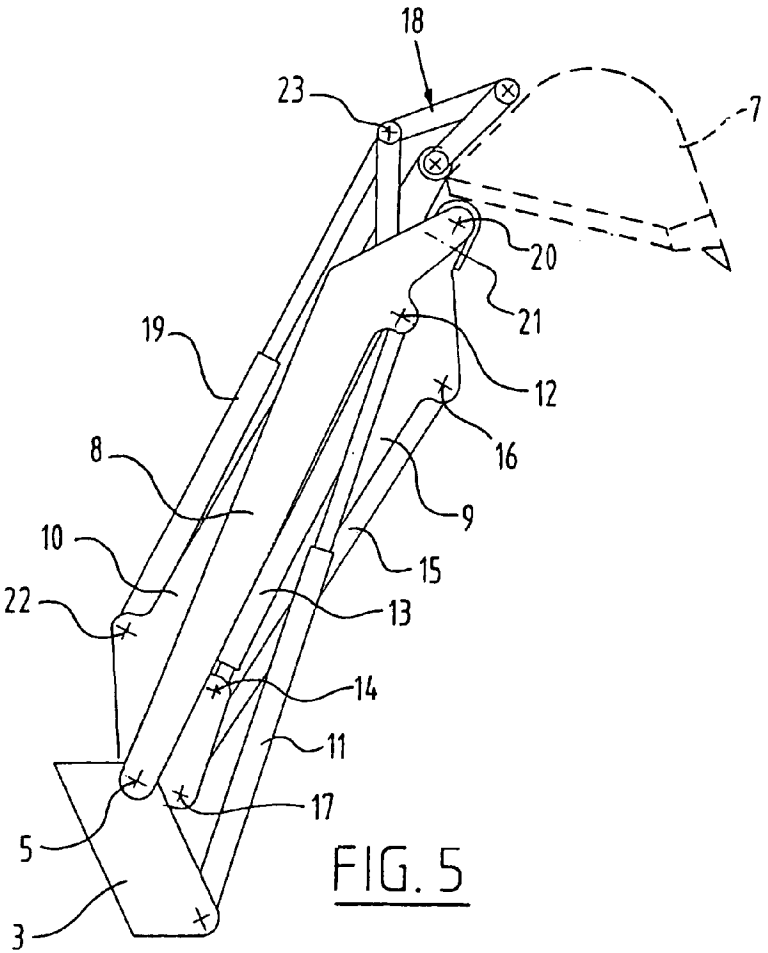
FIG. 5 shows a standing view corresponding with FIG. 3 of the operating arm in the folded-up position, whereby a single arm is obtained.

According to the invention the length of the third articulation is greater than that of the second articulation 9, so that during folding into a situation as shown for instance in FIG. 5, the articulation 10 is first brought to lie against the articulation 9 and then rotated further until 9 together with 10 come to lie between the portal of articulation 8. It is generally the case that a combination of rotations results in folding-up to a single arm. The dimensioning is such that implement 7, here in the form of a digger bucket, comes to lie at the outer end of the first articulation 8 and can there be active.

The length of the articulations can be understood to be such that the distance between rotation point 14 and that of the parallelogram linkage 18 is in any case greater than between pivot points 14 and 20.

Figure 6:
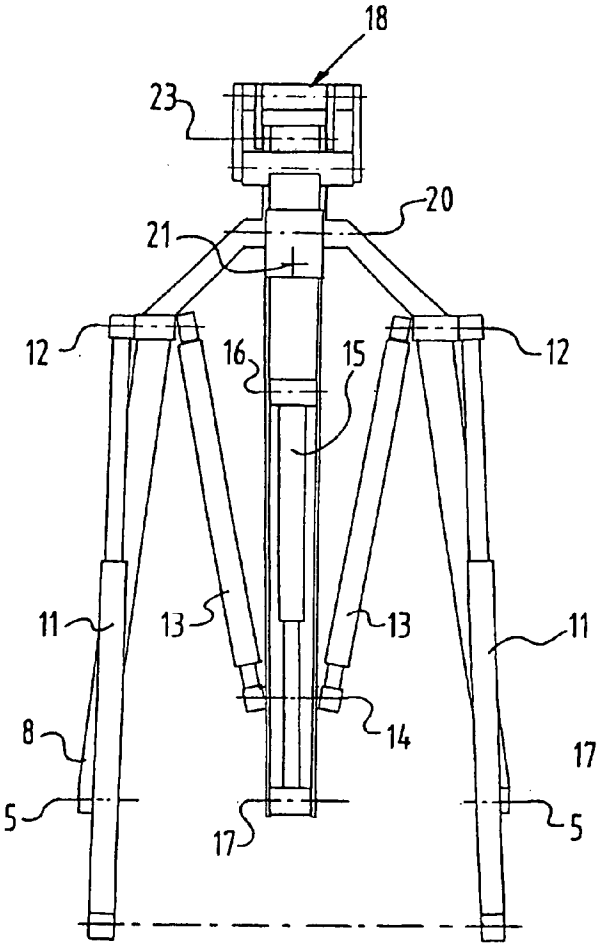
FIG. 6 shows a front view of the arm of FIG. 5.

It is noted that the length of an articulation is of course constant if it is constructed from fixed lengths of material, as shown in FIGS. 4-6.

It is however also possible within the scope of the invention to give the articulations a telescopic form, whereby the length is adjustable. Within the scope of the invention it is thus possible for instance to shorten the second articulation 9 during folding into the position according to FIG. 5, or to lengthen the articulation 10 in order to reach this situation of FIG. 5. The distances between the pivot points are hereby reduced respectively increased.

FIG. 7 shows two embodiments in schematic manner, wherein each line is an articulation with the same reference numerals as in the preceding figures.

Figure 7A:
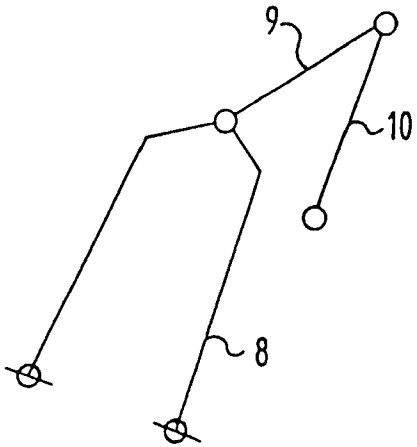
FIGS. 7A,B,C show a schematic illustration of the operating arm of FIG. 2 in different positions.
Figure 7B:
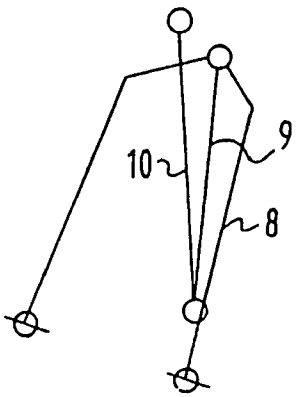
FIG. 7D shows a variant of the operating arm in the digging position.
Figure 7C:
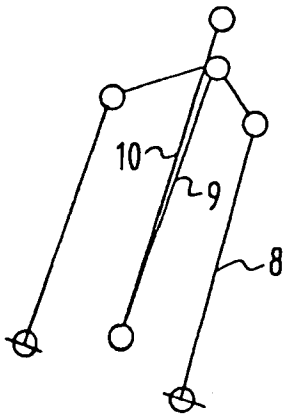

FIGS. 7*a, b* and *c* show respectively the digging position, the intermediate position and the folded-up, lifting or displacing position according to FIG. 5.

Figure 7D:
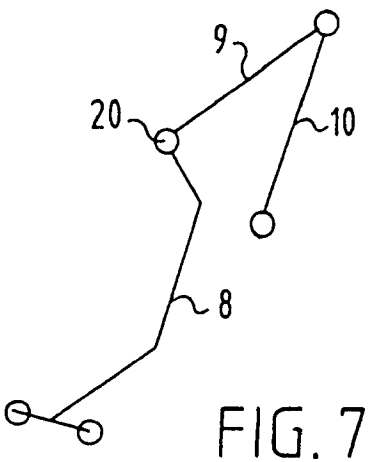

FIG. 7*d* shows the embodiment as also seen in top view according to FIG. 8, wherein the first articulation 8 is not portal-like but takes a single-sided form, wherein a bent construction is however applied such that the articulation 9 can come to lie beside the articulation 8 if this is rotated about pivot point 20.

This bent construction can be two-sided as shown in FIG. 7*d* or one-sided as shown in FIG. 8. It is also possible to make the pivot pin at pivot point 20 so wide that such a folding construction is also possible, wherein it is then possible to dispense with the oblique position of articulation 8 relative to pivot axis 5.

FIG. 8 shows with a broken line an additional strengthening if the construction makes this necessary, whereby the hinge is widened.

FIG. 9 shows a schematic representation of control cab 4 which is deemed to be fixed to a sub-frame 3, on one side of which sub-frame the first articulation 8 can be arranged at pivot point 5, which is placed to the rear in FIG. 9*b*, see 5'. This prevents the articulation 8 blocking the view of the driver too much.

Figure 11:
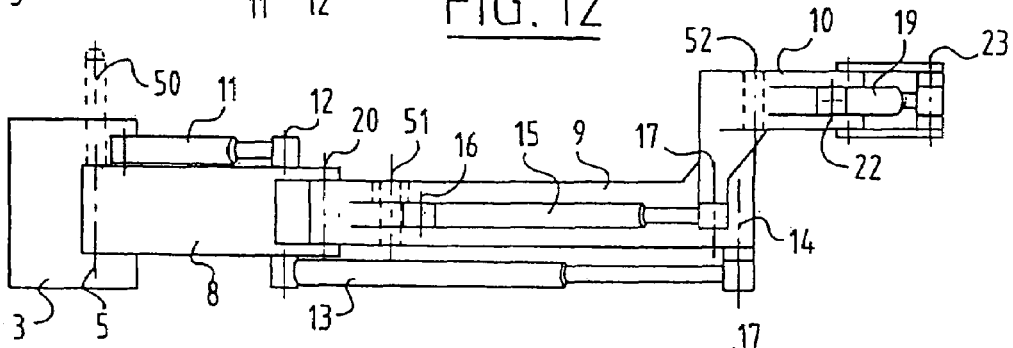
FIG. 11 shows a top view of the digging arm of FIG. 10.
Figure 10:
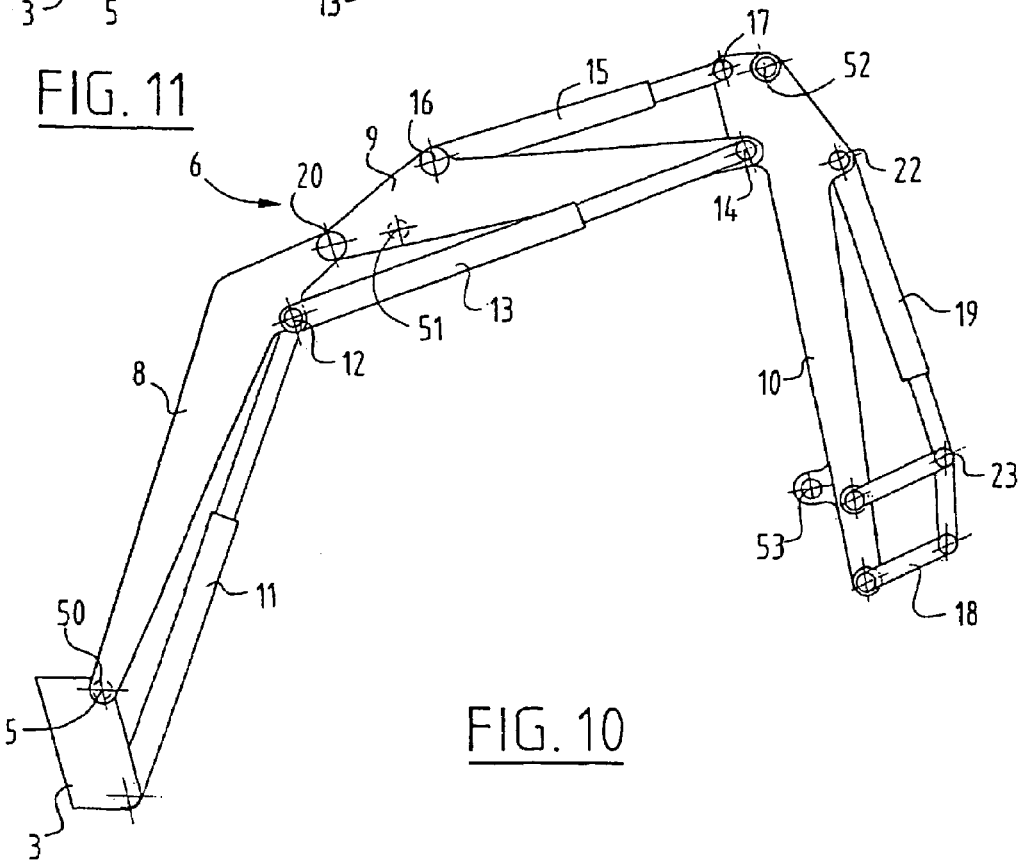
FIG. 10 shows a side view of a second embodiment of the digging arm in the digging position.
Figure 13:
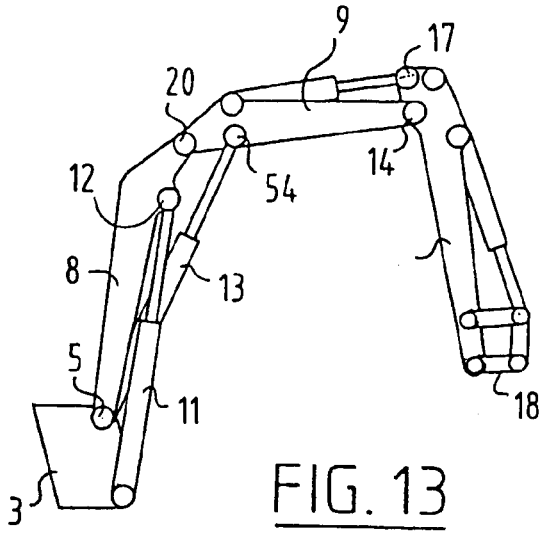
FIG. 13 is a side view of a variant of the digging arm of FIG. 10 with a different arrangement of the control members.
Figure 14:
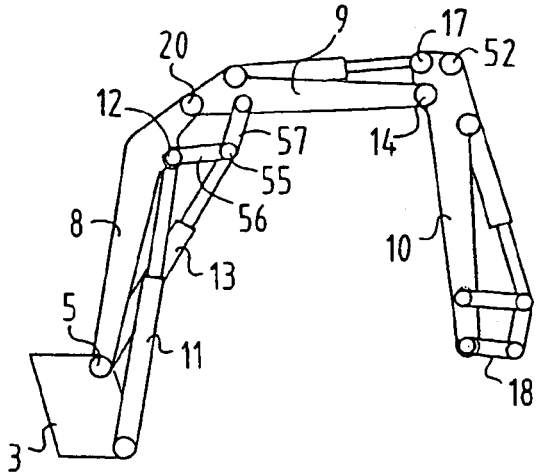
FIG. 14 is a side view of a first variant of the digging arm of FIG. 13 with extra control members.
Figure 15:
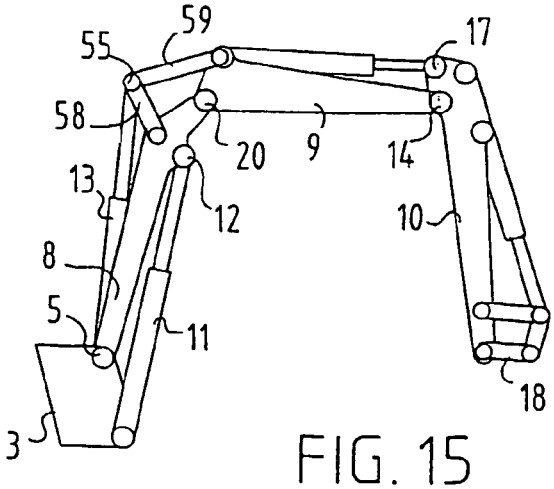
FIG. 15 is a side view of a second variant of the digging arm of FIG. 13 with extra control members.

FIGS. 10 and 11 show a second embodiment of the digging arm which is similar to that of FIG. 3, with the difference that the first articulation is provided with a hydraulic pin 50 which can be arranged in opening 52 to connect the first articulation and sub-frame 3 to the third articulation. The second articulation is likewise further provided with a hydraulic pin 51 which fits into an opening 53 in order to connect the third articulation to the second one.

Figure 12:
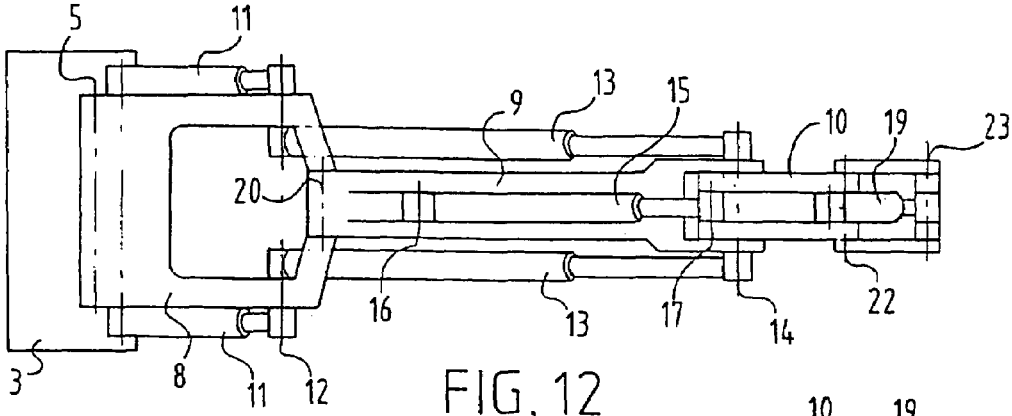
FIG. 12 is a top view of a third embodiment of the digging arm according to the invention.

FIG. 12 shows a top view of a symmetrical variant of the digging arm, wherein the first articulation takes a portal-like form.

FIGS. 13-16 show a number of different embodiments of the digging arm of the apparatus according to the invention, wherein the differences lie substantially in the control members that are used. This indicates that many other variants are possible which also fall within the scope of the invention.

Figure 16:
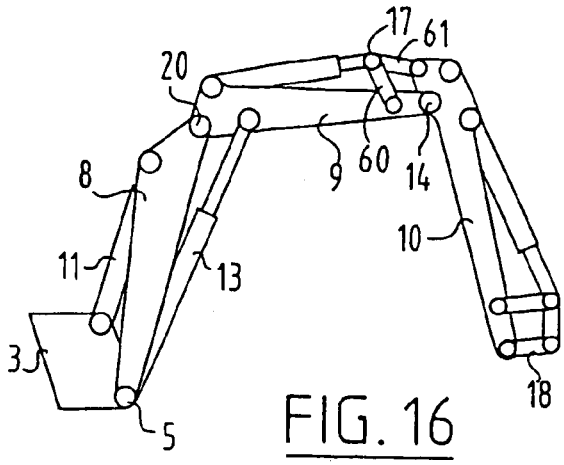
FIG. 16 shows a side view of a third variant of the digging arm of FIG. 13 with extra control members, in a first position.
Figure 17:
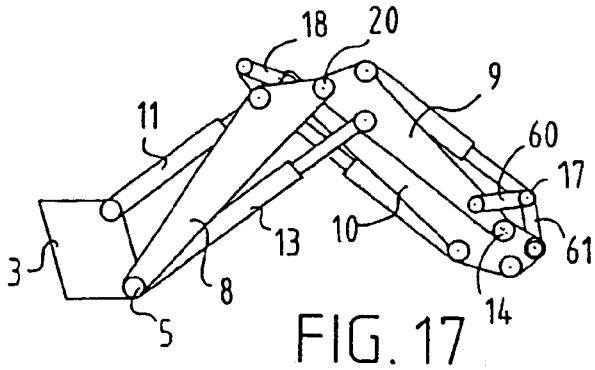
FIG. 17 shows a side view of the third variant of the digging arm of FIG. 16 in a second position.
Figure 18:
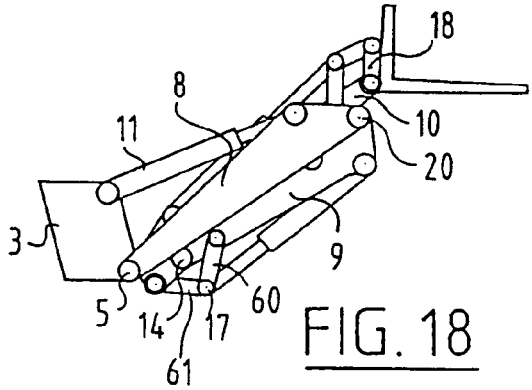
FIG. 18 is a side view of the third variant of the digging arm of FIG. 16 in a third position, wherein an inserting fork is attached.
Figure 19:
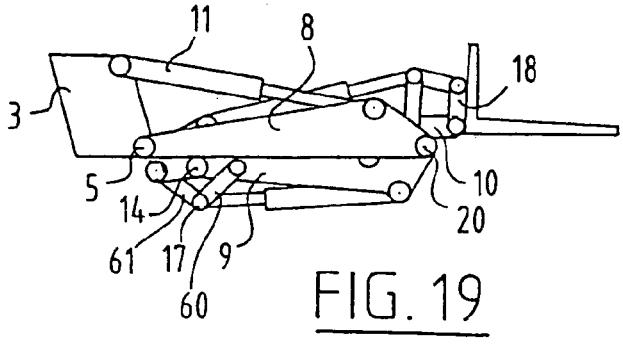
FIG. 19 shows a side view of the third variant of the digging arm of FIG. 17 in a fourth position

FIGS. 17-19 show the variant of FIG. 16 in different positions, with and without attached implement. In FIGS. 18 and 19 can be observed that the attached inserting fork can be held in the same position as the articulations are rotated.

Diverse other constructions are possible, wherein the first articulation 8 can be placed centrally on sub-frame 3 for the purpose of a balanced distribution of weight. Another possibility consists of arranging the first articulation directly onto the displaceable frame 1. A plurality of parallelogram linkages for instance can further also be used to make the articulations rotatable relative to each other.

Diverse other embodiments are possible within the scope of the invention.

The invention claimed is:

1. A mobile apparatus for earth moving and other operations, such as lifting and displacing loads, the apparatus comprising:

a frame displaceable on wheels or caterpillar tracks, an articulated operating arm supported by the frame for carrying an implement, the operating arm consists of at least three articulations connected to each other at pivot points for mutual pivoting on a lying axis, one or more motors for driving the wheels or caterpillar tracks and moving the operating arm, and a plurality of control members for controlling movement of the articulations, wherein the at least three articulations comprise first, second and third adjacent articulations, said second articulation having a first end connected to the first articulation at a first pivot point and having a second end connected to the third articulation at a second pivot point, said first, second and third articulations being foldable against each other resulting in folding-up to a single arm, wherein the second end of the second articulation is being folded against the first articulation, and, wherein the last, third articulation of the operating arm has a greater length than the second articulation, such that when the articulations are folded against each other the implement is freely usable at an outer end of the first articulation.

2. The apparatus as claimed in claim 1, wherein the first articulation is arranged in an offset manner, in top view, relative to the second articulation.

3. The apparatus as claimed in claim 1, wherein the first articulation is portal-like and has an interior width, and the interior width of the first articulation allows passage of the implement.

4. The apparatus as claimed in claim 1, wherein near at least one of the pivot points between the articulations or between the first articulation and the frame, a pivot point with a vertical axis is arranged.

5. The apparatus as claimed in claim 1, wherein the third articulation is arranged in an offset manner, in top view, relative to the second articulation.

6. The apparatus as claimed in claim 1, wherein all of the at least three articulations are arranged in an offset manner, in top view, relative to each other.

7. The apparatus as claimed in claim 1, wherein at least two control members are arranged between one pair or each pair of articulations.

8. The apparatus as claimed in claim 1, wherein the articulations are provided with connecting means for mutual connection of the articulations in the folded position, or for connection to the frame.

9. A mobile apparatus for earth moving and other operations, such as lifting and displacing loads, the apparatus comprising:

a frame displaceable on wheels or caterpillar tracks, an articulated operating arm supported by the frame for carrying an implement, the operating arm consists of at least three articulations connected to each other at pivot points for mutual pivoting on a lying axis, one or more motors for driving the wheels or caterpillar tracks and moving the operating arm, and a plurality of control members for controlling movement of the articulations, wherein the at least three articulations comprise first, second and third adjacent articulations, said second articulation having a first end connected to the first articulation at a first pivot point and having a second end connected to the third articulation at a second pivot point, said first, second and third articulations being foldable against each other resulting in folding-up to a single arm, wherein the second end of the second articulation is folded against the first articulation, and, wherein the last, third articulation of the operating arm is formed by a leg having a length which is smaller than or equal to the length of the second articulation, wherein a parallelogram linkage is arranged on the outer end of the leg, which linkage has dimensions such that the total length of the leg plus the parallelogram linkage is greater than the length of the second articulation, such that when the articulations are folded against each other the implement is freely usable at an outer end of the first articulation.

10. The apparatus as claimed in claim 8, wherein the connecting means for mutual connection of the articulations are configured as a connection in a direction perpendicular to the articulations.

* * * * *